United States Patent [19]

Larsen

[11] Patent Number: 4,509,686

[45] Date of Patent: Apr. 9, 1985

[54] WATER SPRINKLING APPARATUS

[76] Inventor: Donald R. Larsen, 358 E. 800 North, American Fork, Utah 84003

[21] Appl. No.: 388,693

[22] Filed: Jun. 15, 1982

[51] Int. Cl.[3] ..... B05B 3/16

[52] U.S. Cl. ..... 239/239

[58] Field of Search ..... 239/237, 239

[56] References Cited

U.S. PATENT DOCUMENTS 4,335,853 6/1982 Szemeredi et al. ..... 239/239

*Primary Examiner*—Andres Kashnikow

*Assistant Examiner*—James R. Moon, Jr.

*Attorney, Agent, or Firm*—Terry M. Crellin

[57] ABSTRACT

A water sprinkler device of the type having a reciprocating or oscillating sprinkler nozzle is provided comprising a novel fluid drive system for the nozzle movement. Water upstream from the spray nozzle is partially diverted to a piston chamber. Water entering the chamber moves a piston in reciprocating movement within the chamber. A rack is connected to the piston to move outside the chamber with the same reciprocating motion as the piston. The rack engages a gear associated with the sprinkler nozzle to impart oscillating rotational movement to the sprinkler nozzle as the rack moves in its reciprocating motion.

5 Claims, 19 Drawing Figures

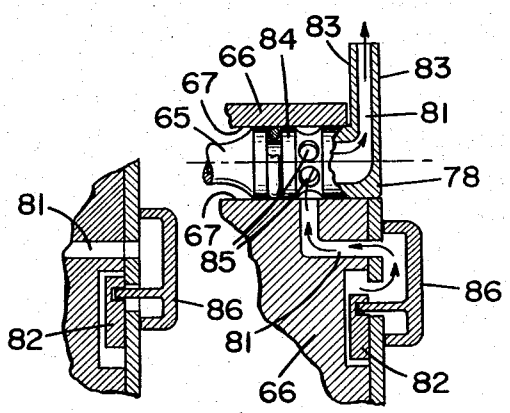
FIG. 12
FIG. 13
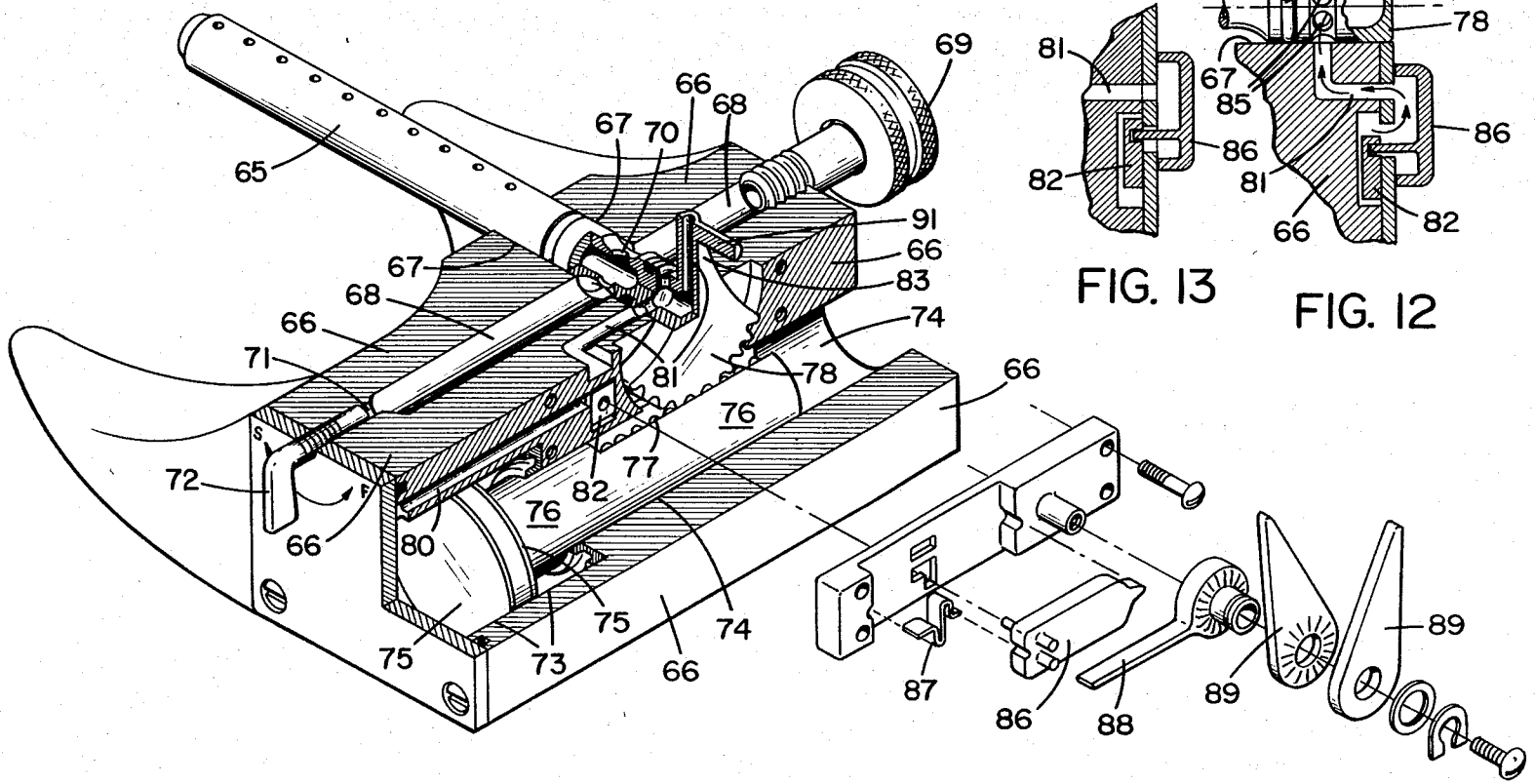
FIG. 11

WATER SPRINKLING APPARATUS

BACKBROUND OF THE INVENTION

1. Field

This invention relates to water sprinkling devices or apparatus of the type having a reciprocating oscillating sprinkler nozzle. More particularly, the invention pertains to such sprinkler devices or apparatus in which a fluid drive system is used to produce the reciprocating or oscillating motion to the sprinkler nozzle.

2. State of the Art

Sprinklers of various types for different water sprinkling applications are in common use. Sprinklers have been proposed utilizing various mechanical drive mechanisms for imparting reciprocating or oscillating motion to the sprinkler nozzle. Two of the more common mechanisms for imparting motion to the spray nozzle are the impact or swinging arm mechanism and the turbine or water paddle type. In the swinging arm mechanism, the arm impacts the stream of water from the nozzle, with the force of the water swinging the arm away from the water stream against a spring. The spring then forces the arm to swing back into contact with the water stream. In the turbine or water paddle type, water flowing through the sprinkler turns a paddle wheel or turbine, and a drive mechanism is associated with the paddle or turbine for imparting motion to the sprinkler nozzle.

Numerous problems have been experienced with the prior art devices. The swinging arm type requires a substantial water pressure to operate, and when water pressures fall below the necessary pressure, the sprinkler nozzle moves in an erratic nonuniform motion or fails to move at all. Further, the impact of the swinging arm results in an erratic, jerky motion of the nozzle under optimum conditions which results in nonuniform application of water to the area being irrigated. The paddle wheel or turbine type generally have a more uniform nozzle movement than the swinging arm type. However, the latter type require a complex drive system which results in a pause during the travel of the sprinkler nozzle at the extremes of the travel, that is, when the nozzle reverses its direction of travel. This pause or at least slow reversal of direction results in nonuniform application of water to the area being irrigated. In addition, the paddle wheel or turbine and its associated drive means is prone to mechanical malfunction.

Heretofore, to the best of the present inventor's knowledge, there has been no suggestion of utilizing a fluid powered piston drive system to impart motion to the sprinkler nozzle or of a system wherein the piston is made to operate in reciprocating fashion to impart reciprocal or oscillatory motion to the sprinkler nozzle.

OBJECTIVES

It is a principal objective of the present invention to provide novel sprinkler apparatus that has a unique drive means for imparting reciprocating or oscillating motion to the sprinkler nozzle, wherein the drive means incorporates a fluid driven piston which is adapted to reciprocate within a piston chamber in the sprinkler apparatus. Another objective is to provide a sprinkler apparatus which is relatively simple in construction and operation so as to be reliable and require at most only minimal maintenance. A still further objective is to provide sprinkler apparatus in which the reciprocating or oscillating motion of the sprinkler nozzle is uniform over the full travel of the nozzle, with the speed at which the nozzle travels being adjustable. A further objective is to provide sprinkler apparatus which operates over a wide range of water pressure, including pressures as low as 15 psi guage. A still further objective is to provide a unique nozzle construction in which a substantially uniform application of water is obtained along the full length of the water trajectory from the nozzle. An even further objective is to provide sprinkler apparatus in which no backsplash is obtained at the nozzle and the operation of the apparatus is quiet.

BRIEF DESCRIPTION OF THE INVENTION

The above objectives are achieved in accordance with the present invention by a water sprinkler device including a body having a main water flow passageway for flow of water from the inlet connection of the sprinkler to a spray nozzle from which the water is ejected. Means are provided in the body for diverting a portion of the water upstream of the spray nozzle to a piston chamber which is provided in the body of the sprinkler device separate and apart from the main water flow passageway. Water entering the chamber moves a piston in the chamber in reciprocating movement within the chamber. An exit port with associated valve means is provided at one of the ends of the chamber. The piston is adapted to move away from the end of the chamber having the exit port when the valve at the exit port is closed, and to move towards the end with the exit port when the valve at the exit port is open.

A rack is connected to the piston to move outside the chamber with the same reciprocating motion as the piston. The rack engages a gear associated with the sprinkler nozzle to impart oscillating rotational movement to the sprinkler nozzle as the rack moves in its reciprocating motion. Means are provided in association with the rack and the body of the sprinkler nozzle to open and close the valve on the port of the chamber. The means for opening and closing the port can be adjusted to provide various degrees of travel of the piston, rack and nozzle for each cycle. Adjustable valve means can also be provided to control the flow of water which is diverted from the main flow channel to the piston chamber. Varying of the flow of diverted water to the piston chamber in turn varies the rate of longitudinal movement of the piston within the chamber. Thus, the spray nozzle can be set to oscillate at various speeds as well as various degrees of travel during each oscillation.

Additional objects and features of the present invention will become apparent from the following detailed description, taken together with the accompanying drawings.

THE DRAWINGS

Preferred embodiments of the present invention representing the best modes presently contemplated of carrying out the invention are illustrated in the accompanying drawings, in which:

FIG. 11 is a pictorial view of another embodiment of a sprinkler in accordance with the invention, with portions of the sprinkler cut away to reveal internal parts;

FIG. 12 is diagramatic cross-sectional representation through the pressure relief valve of the sprinkler of FIG. 11 showing the path of the released water when the valve is in its open position;

FIG. 13 is a partial cross-sectional representation showing the pressure relief valve of FIG. 12 in its closed position;

DETAILED DESCRIPTION OF THE PREFERRED EMBODIMENTS

Figure 1:
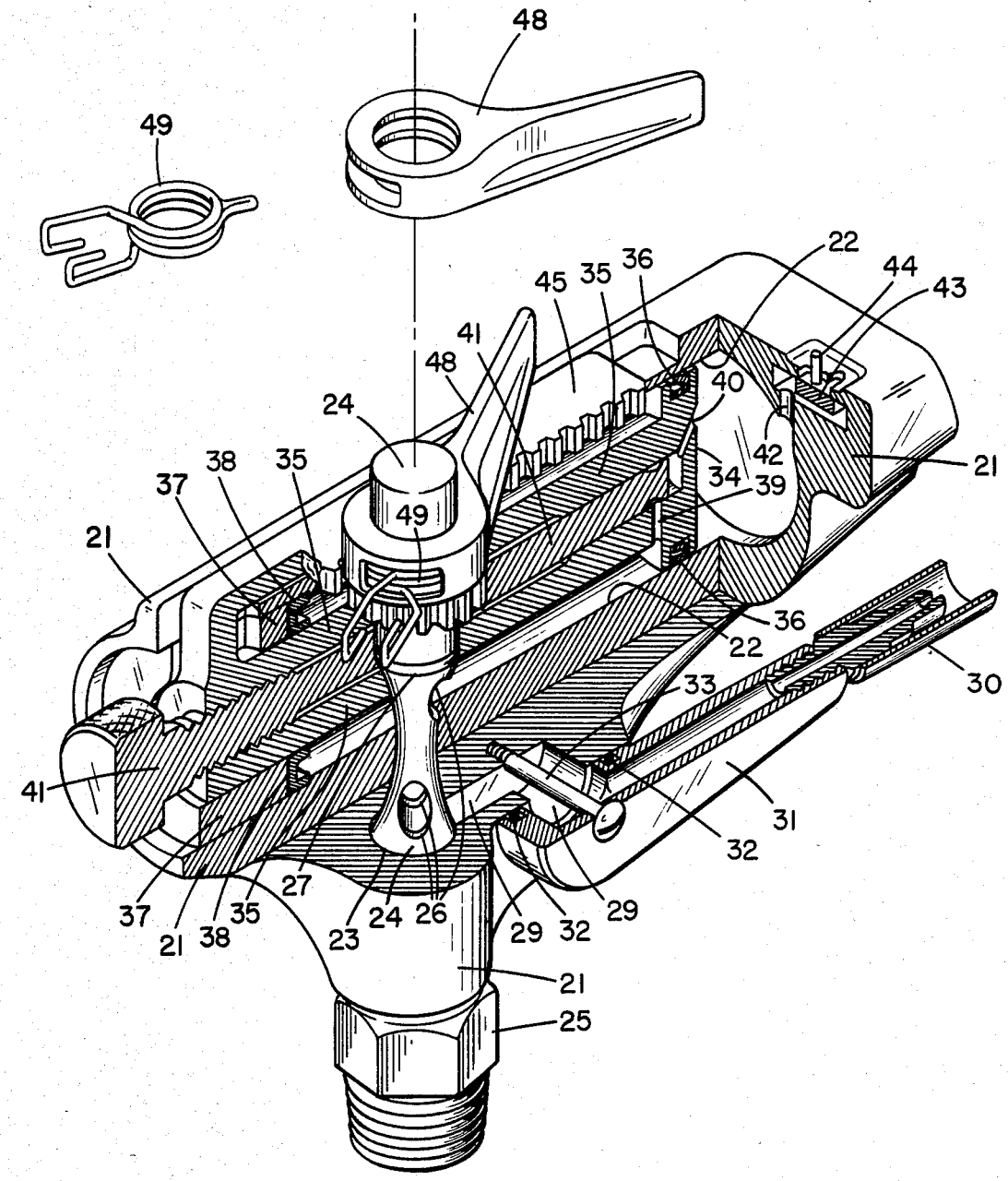
FIG. 1 is a pictorial view of a reciprocating-type sprinkler in accordance with the invention, with portions of the sprinkler cut away to reveal internal parts.

Several preferred embodiments of the sprinkler apparatus of the present invention are shown in the drawings and will be described hereinafter. Like parts in the various embodiments and view shown in the drawings will be identified with the same reference numbers.

Figure 2:
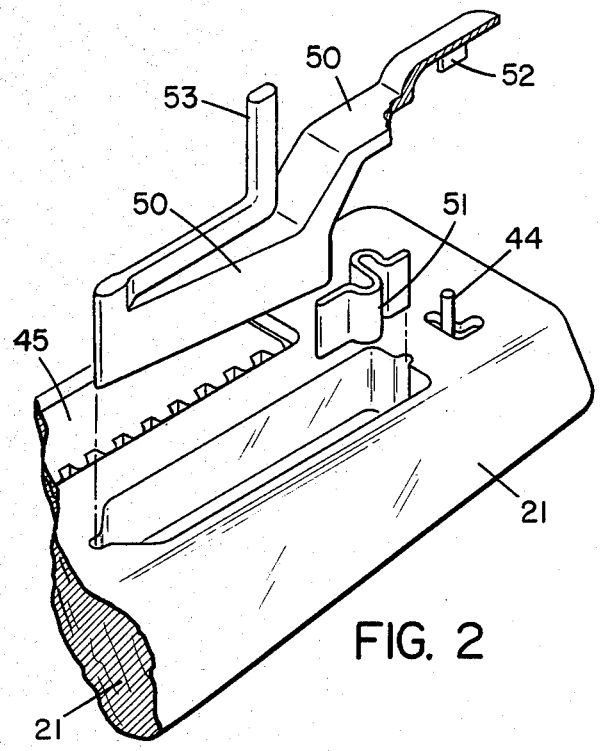
FIG. 2 is a pictorial of the end portion of the sprinkler nozzle of FIG. 1, showing detail which is broken away in FIG. 1.
Figure 3:
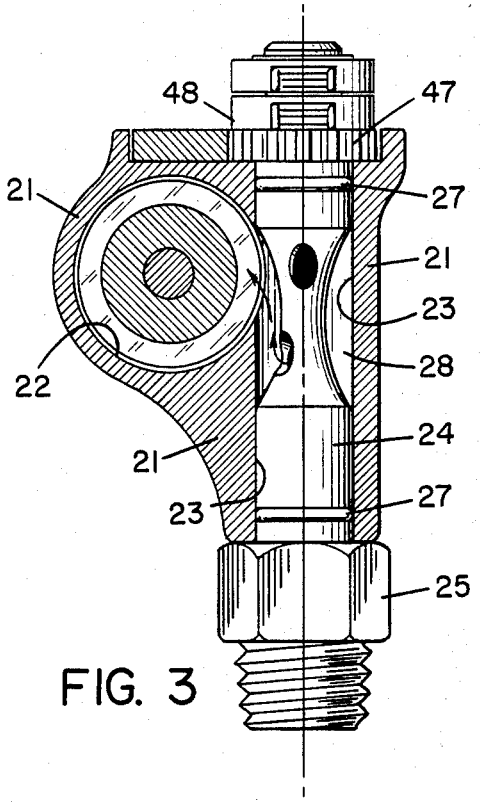
FIG. 3 is a vertical cross-sectional view through the axis of the water inlet spindle showing the water inlet spindle in elevation.

Preferred embodiments of sprinkler apparatus in accordance with the invention which incorporate a spray nozzle adapted to reciprocate about an upstanding axis is shown in FIGS. 1–10. The sprinkler apparatus comprises a block housing 21 having intersecting elongate cylindrical bores 22 and 23 (FIG. 3). The larger bore 22 extends inwardly from one end of the housing 21. The large bore 22 is closed at its inward end adjacent the other end of the housing 21, with the bore 22 being substantially parallel with the longitudinal orientation of the housing 21. A smaller bore 23 extends through the housing 21 in a direction substantially normal to the axis of the larger bore 22. The smaller bore 23 is located adjacent to or at least more near to the end of the housing 21 with the open bore 22 than to the other or closed end of the housing 21. As mentioned above, the bores 22 and 23 intersect at least partially as best shown in FIG. 3.

A shaft 24 extends through the smaller bore 23. A hollow nipple 25 is attached to the lower end of the shaft 24. The upper end surface of the nipple 25 abuts the surface of the housing 21 adjacent to the lower open end of the bore 23, so as to form a bearing surface which supports the housing 21 for rotation about the shaft 24. The other end of the nipple 25 is threaded, whereby the shaft 24 may be attached to a conventional base stand (not shown) and water supply. The other end of the shaft 24 extends outwardly from the upper open end of the bore 23 and is adapted to receive adjustable travel stop members as will be described more fully hereinafter.

The shaft 24 is hollow from the nipple 25 to at least the intersection between the bores 22 and 23. However, the upper end of the shaft 24 is solid so that the hollow portion is only open through the open nipple 25 at the lower end of the shaft 24. The outer surface of the shaft 24 has an inwardly concaved section located adjacent to the intersection of the bores 22 and 23 when the shaft 24 is in its operable position within bore 23. The concaved section of the shaft 24 curves inwardly sufficiently that no portion of the shaft 24 is within the cylindrical area of the bore 23. At least one opening 26 is provided in the side wall of the shaft 24 in the area of the concaved section of the shaft 24. As illustrated, three openings 26 are provided. The openings 26 establish flow communication from the hollow inside of shaft 24 to the annular space 28 formed between the concaved section of the shaft 24 and the bores 22 and 23. The annular space 28 forms an inlet chamber within the housing 21, with water flowing from the hollow shaft 24 via way of the nipple 25 to the inlet chamber. A pair of O-rings 27 are provided at opposite ends of the shaft on each side of the concaved section to form a fluid seal between the shaft 24 and the bore 23, and prevents escape of water from the inlet chamber 28 past the shaft 24 within the bore 23.

The lower portion of the inlet chamber 28 is associated with a main flow channel 29 which directs water to a spray nozzle 30. As shown in FIG. 1 the main flow channel 29 comprises a channel within the housing 21 extending from the inlet chamber 28 to an opening at the side of the housing 21. An elongate, adjustable, hollow member 31 is attached at one of its ends to the housing 21 so as to cover the opening in the channel 29. A corresponding opening is provided in the hollow member in alignment with the opening from the channel 29 so as to establish flow communication from the channel 29 to the hollow member 31. An O-ring 32 is provided between the housing 21 and the member 31 around the aligned openings therein so as to prevent escape of water from between the housing 21 and the member 31. The spray nozzle 30 is attached to the other end of the member 31 in flow communication with the hollow interior thereof. The member 31 is preferably attached to the housing 21 by a screw member 33 which permits the member 31 to pivot about the screw member 33. This allows the elevational angle of the nozzle 30 to be adjusted to various angles.

A piston 34 fits snugly within the large bore 22 so that the bore in effect becomes a piston chamber. A piston rod 35 extends from the piston 34 back toward the open end of the bore 22. A U-cup type seal 36 is provided around the piston 34 so as to form a sealed chamber between the piston 34 and the closed end of the bore 22. A torus or doughnut-shaped member 37 is provided adjacent to the open end of the bore 22 in the housing 21. The member 37 acts as a journal bearing or bushing for the piston rod 35, and the piston rod is adapted to move back and forth in the bearing or bushing 37. A circular seal member 38 of the type having a U-shaped cross section is positioned on the inside face of the bearing or bushing 37 and provides a seal between the exterior surface of the piston rod 35 and the inner surface of the bore 22, and a second sealed chamber, being generally a cylindrical torus in shape, is formed between the seal member 38 and piston 34. The second sealed chamber is in fluid flow communication with the annular space or inlet water chamber 28 formed by the concaved section of the shaft 24 in bore 23. Thus, water can flow from the inlet chamber 28 to the second sealed chamber formed around the piston rod 35 between the seal member 38 and piston 34.

Means are provided for establishing a controlled flow of water from the second sealed chamber on one side of the piston 34 to the first sealed chamber on the other side of the piston 34. Preferably, means are also provided for adjusting the flow rate of the flow of water from the second sealed chamber to the first sealed chamber. As shown in FIG. 1, the piston rod 35 is hollow along its length with the hollow portion being closed at one end of the piston rod 35 by the piston 34. A relatively small bore 39 extends through the wall of the piston rod 35 to the hollow section thereof, with the bore 39 being positioned adjacent to the piston 34. A second relatively small bore 40 extends through the piston so as to interconnect the hollow portion within the piston rod 35 and the first sealed chamber on the other side of the piston 34. An adjusting rod 41 extends through the hollow portion of the piston rod 35, with the rod 41 being screwed into the end of the hollow portion of the piston rod. The other end of the adjusting rod 41 is adapted to adjustable occlude the opening of the small bore 39 as the rod 41 is advanced and rectracted.

Figure 5:
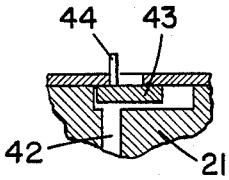
FIG. 5 is a partial vertical cross-sectional view through the pressure release valve of FIG. 4, showing the valve in its closed position.
Figure 6:
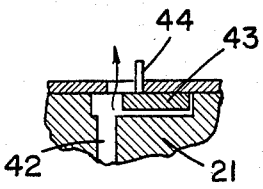
FIG. 6 is a partial vertical cross-sectional as in FIG. 5 but showing the valve in its open position.

Means are provided for periodically relieving water pressure and exhausting water fom the first sealed chamber which is located between the piston 34 and closed end of bore 22. As shown in FIGS. 1, 2 and 4–6, an exhaust passage 42 is bored through the upper side of the housing 21 to a valve chamber in which a sliding valve 43 is positioned. As best shown in FIGS. 5 and 6, when the slide valve 43 is closed over an outlet port of the valve chamber, the exhaust passage is effectively closed off. Conversely, when the slide valve 43 is moved to open the outlet port, water can be exhausted from the first sealed chamber through the exhaust passage 42 and the open outlet port in the valve chamber. The slide valve has a pin 44 extending upwardly through the outlet port and is activated by operating means to be described hereinafter.

In use, water enters the hollow shaft 24 through the nipple 25 and flows into the inlet chamber 28. The main flow of water then flows from the inlet chamber 28 through the flow channel 29 to the nozzle 30. A relatively small portion of the water from the inlet chamber 28 upstream of the spray nozzle 30 is diverted to the second sealed chamber around the piston rod 35. During the cycle of operation in whih the slide valve 43 is open, water flows from the second sealed chamber through the bores 39 and 40 to the first sealed chamber and then through exhaust passage 42 to the atmosphere. The pressure drop which occurs across the bores 39 and 40 creates an unbalanced force on the piston 34 which biases the piston to move toward the closed end of the bore 22. This movement, of course, continuously decreases the volume of the first sealed chamber, i.e., the chamber between the piston 34 and the closed end of the bore 22. However, the water is exhausted from this chamber of declining volume through the exhaust passage 42.

In the cycle of operation in which the slide valve 43 is closed, water flows as explained above from the inlet chamber 28 to the second sealed chamber between the piston 34 and the closed end of the bore 22. However, the water cannot escape from the second sealed chamber inasmuch as the slide valve 43 is closed thereby effectively occluding the exhaust passage 42. The water pressure builds up substantially equally on both sides of the piston, although a very small pressure drop likely occurs across the bores 39 and 40. But, because of the significant difference in the areas exposed to the pressure on the opposite sides of the piston (the entire downstream face of the piston is exposed to pressure whereas only the torus near the outer portion of the upstream side of the piston is exposed), the piston 34 is biased to move in a direction away from the closed end of the bore 22. Thus, the piston can be made to reciprocate back and forth within the bore 22 by controlling the slide valve 43.

The reciprocating movement of the piston 34 is utilized to impart reciprocating movement to the sprinkler in the following manner. The piston rod 35 has a length sufficient to project outwardly of the seal and bearing member 37 which is adjacent to the otherwise open end of the bore 22 even when the piston is in its extreme position adjacent to the closed end of the bore 22. A rack 45 extends along the top of the housing 21, preferably within a recessed slide track on the housing 21. The trailing end of the rack is attached to the end of the piston rod 35 by an upstanding connecting link 46. Thus, as the piston 34 reciprocates within the bore 22, the rack 45 moves back and forth along the top of the housing 21, preferably within a slide recess formed therein in which the rack 45 is received for its sliding motion. The rack engages or meshes with a gear 47, which is firmly attached to or formed integrally with the portion of the shaft 24 which extends above the top of the housing 21. As the rack 45 moves, it must move around the gear 47 and thus imparts rotational movement to the housing 21 and sprinkler nozzle 30 about an axis through the shaft 24. As the piston 34 and rack 45 move in a direction away from the closed end of the bore 23, the housing 21 and sprinkler nozzle 30 will rotate clockwise about the shaft 24. When the piston 34 and rack 45 reverse their directions and move in a direction toward the closed end of the bore 22, the housing 21 and spray nozzle 30 reverse and rotate counterclockwise relative to the shaft 24. Thus, the sprinkler nozzle can be made to reciprocate clockwise then conterclockwise by appropriate control of the slide valve 43.

The length of the piston rod 35 and the rack 45 are such that the housing 21 and sprinkler nozzle 30 will rotate in about a complete circle as the piston moves from one of its extreme positions to its other extreme position. The means for controlling the slide valve 43 can also be used to limit the rotational travel of the housing 21 and sprinkler nozzle 30. A pair of limit stop pointers 48 are adapted to fit on the upper end of the shaft 24. The limit stop pointers 48 are attached to the shaft 24 by coil springs 49 which make frictional engagement with the shaft 24. The coil springs 49 have finger extensions which when squeezed allows the coil spring to be moved on the shaft 24, thereby permitting adjustment of the pointers 48 to any desired position.

The limit stop pointers 48 are adapted to activate means for operating the slide valve 43. As shown in FIG. 2 a travel stop lever means 50 is mounted in a well in the top of the housing 21. The lever means 50 is adapted to work on an over-center type action in which the lever 50 is moved in a snap-action from one extreme position to the other as is well known in the art. As illustrated, in FIG. 2, one end of the lever means 50 is mounted in a pivot notch in the corresponding end of the well such that the lever means 50 can pivot about the notch in a place parallel with the top of the housing 21. The mid-portion of the lever means engages one end of the ribbon spring 51 which has a general "S" shape, with the two ends thereof projecting in opposite directions along the central axis of the S-shaped spring. The other end of the spring 51 engages a pivot notch in the mutually corresponding end of the well. The other end of the lever means 50 extends upwardly from the mid portion and then extends back over the spring 51 and the top of the housing 21. The free end of the other end of the lever means 50 is adapted to engage the pin 44 which extends upwardly from the housing 21. As illustrated, the free end of the extending other end of the lever means 50 has a pair of tabs 52 extending downwardly therefrom. The tabs 52 form a channel which encloses the pin 44 of the slide valve 43. When the lever means 50 moves one way, it pushes the slide valve 43 the same way, and when the lever means 50 moves back, it pushes the slide valve 43 back. The spring 51 snaps the lever means 50 to its extreme positions any time the lever means 50 is pushed to and just beyond the center position between the two extreme positions of its movement. A contact bar or rod 53 extends upwardly from the lever means 50 and is adapted to be engated by the limit stop pointers 48. In operation, the limit stop pointers 48 are adjusted to the desired positions, and when the sprinkler unit moves to either of the two limits as defined by the limit stop pointers 48, the slide valve 43 is alternatively closed and opened thereby successively reversing the direction of the sprinkler unit.

A modified version of means for releasing the pressure in and exhausting water from the chamber formed between the piston 34 and the closed end of the bore 22 is shown in FIGS. 7–10. In the modified version, the closed end of the bore 22 is in the shape of a funnel or cone, with the surface of the end coverging to a pressure release port 54. A ball 55 is positioned within the chamber, and when the ball 55 is seated in the pressure release port 54, it forms a valve. Of course, the ball 55 tends to seat in the pressure release port 54 any time that fluid under pressure is contained within the chamber. Means are provided for opening and closing the ball valve to change the direction of travel of the piston 34 in the same manner as opening and closing of the slide valve 43 in the embodiment illustrated in FIGS. 1–6 as previously described.

Figure 7:
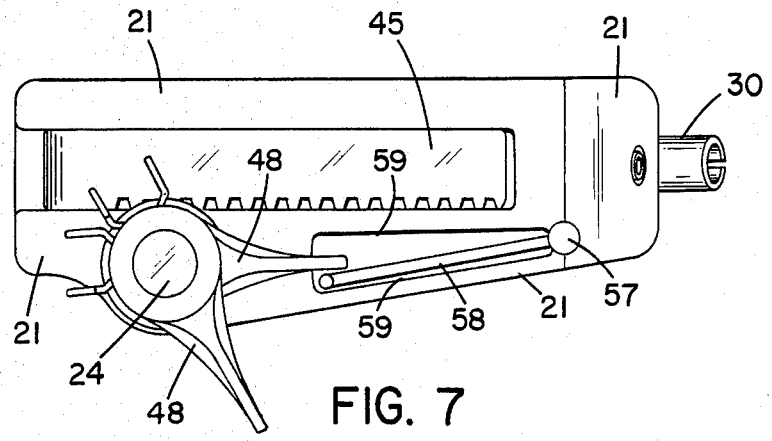
FIG. 7 is a top view of a sprinkler nozzle which is similar to the sprinkler nozzle of FIG. 1 except that an alternate embodiment of the pressure relief valve mechanism is employed.
Figure 10:
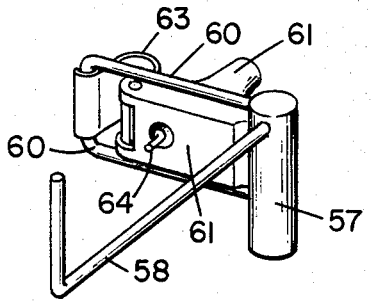
FIG. 10 is a pictorial of the activating mechanism of the pressure relief valve of FIG. 9 shown in isolation.
Figure 8:
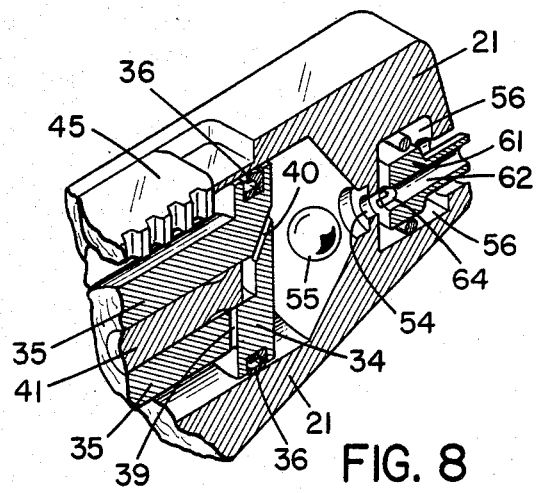
FIG. 8 is a partial pictorial sectional view taken on the longitudinal axis of the piston chamber and through the pressure relief valve mechanism.
Figure 9:
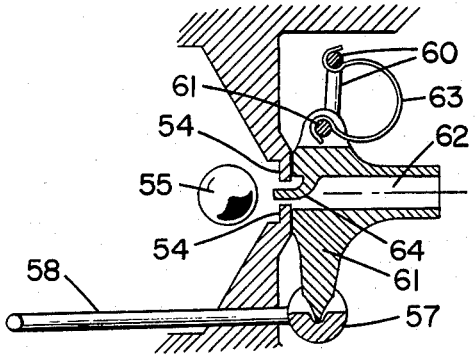
FIG. 9 is a partial horizontal cross section through the pressure relief valve mechanism of FIG. 7.

As illustrated in FIGS. 8–10, the means for controlling the ball valve comprises an activator positioned downstream of the pressure release port 54. The activator is positioned within a recess 56 in the housing 21. The recess 56 has an opening therefrom through which a portion of the activator extends. The activator comprises a cylindrical pivot rod which is journaled at the two ends in the housing 21. The upper end of the pivot rod 57 extends through the journal in the top of the housing 21 and has an elongate lever 58 extending backward along the top surface of the housing 21. The free end of the lever 58 is upturned so as to be adapted for contact with the limit stop pointers 48. A well 59 can be formed in the upper surface of the housing to receive the lever 58 as shown in FIG. 7. By providing a well 59, the pivot rod 57 need not extend above the top of the housing 21. Instead, the well 59 forms a slot in the journal opening of the housing 21 and the lever 58 extends from the slot in the journal opening into the well 59.

A U-shaped support member is attached at its otherwise free ends to the pivot rod 57 so as to form a substantially rectangular support frame positioned within the recess 56 in the housing 21. A pressure release member 61 is mounted within the rectangular support frame formed by the support member 60. The member 61 has a generally rectangular base portion adapted to fit within the support member 60, and a nozzle portion extending backwardly from the base portion. The nozzle portion has a bore 62 through the nozzle and the base portions of the member 61. The face of the base portion surrounding the bore 62 is adapted to seat against or abut the surface of the recess 56 surrounding the pressure release port 54 when the member 61 is in its forward position. The member 61 is supported such that a clockwise movement of the pivot rod 57 and support member 60 will move the member 61 away from the pressure relief port 61. Conversely, a counterclockwise movement of the pivot rod and support member will move the member 61 into its position seated against the pressure relief port. When member 61 is seated against the pressure relief port 51, the bore 62 therein is in coaxial alignment with the port 51.

As illustrated, the rectangular base portion of the pressure release member 61 has a knife edge along one edge which is supported in an elongate notch in the pivot rod 57. The opposite edge of the base portion is supported from the end of the U-shaped support member 60 by a coiled hairspring 63. The hairspring support operates in an overcenter type operation to move the pressure relief member. As can best be seen in FIG. 9, when the lever 58 is moved so as to rotate the pivot rod 57 counterclockwise and the end of the support member 60 to which the spring 63 is attached to a point wherein that end of the support member moves slightly past the central plane through the base portion of the member 61, the hairspring 63 will bias the member 61 to make a quick, snap-like movement away from the release port 54. Conversely, when the lever 58 is then moved so as to rotate the pivot rod 57 clockwise, the member 61 is constrained from moving clockwise with the support member 60 because of the nozzle 62 extending from the opening from the recess 56 in the housing 21. Instead, the end of the support member 60 to which the spring 63 is attached rotates to a point wherein the end of the support member passes the central plane through the base portion of the member 61. The hairspring 63 then biases the member 61 to make a quick, snap-like movement back towards the release port 54 (this position is shown in FIG. 9).

A horn 64 extends from the wall of the bore 62 in the pressure relief member 61 and extends slightly beyond the open end of the bore 62 which seats against the pressure release port 54. When the member 61 is seated against the port 54, the horn 64 extends through the port 54 and disengages the ball 55, so that water can flow around the ball, through the port 54 and out the bore 62 of the member 61. When the member 61 is moved away from the port 54, the end of the horn 64 withdraws into the recess 56 and the ball 55 reseats in the port 54. The limit stop pointers 48 can be adjusted as discussed previously so as to activate the lever 58 at various positions in the travel of the piston 34, and, thus, the adjustment of the pointers 48 establishes the limits of the travel of the sprinkler unit.

The principals of the present invention can be used to provide an oscillating type sprinkler as shown in FIG. 11–13, wherein a substantially horizontally extending spray tube 65 is adapted to oscillate about a substantially horizonal axis through the end of the spray tube. Spaced openings are provided along the spray tube through which water is sprayed. As illustrated, one end of the spray tube 65 is mounted within a bore 67 within a housing 66. The spray tube 65 is adapted to rotate within the bore about an axis coincident with the bore and the one end of the spray tube 65.

A cross-bore 68 extends from one end of the housing 66 and intersects the bore 67 in which the spray tube 65 is mounted. A hose bib 69 is attached to the open end of the bore 68 and is adapted to be connected to a supply of water. Water flows through the bore 68 and openings 70 in the spray tube 65 at the intersection of the bores 67 and 68. The water then flows through the spray tube 65 and is sprayed from the speed opening along the spray tube 65.

As illustrated, the cross bore 68 extends through the housing 66 beyond the intersection with the bore 67 to a point near the other end of the housing 66. A smaller bore 71 extends from the other side of the housing 66 to meet the inner end of the cross bore 68. A threaded insert member 72 is provided in the bore 71 and means are provided on the outside of the insert member 72 for turning the insert member 72 into or out of the bore 71.

A piston chamber 73 is provided in the housing 66, with the axis of the piston chamber 73 being substantially normal to the bore 67 and offset downwardly from the bore 67. A smaller bore 74 extends from the piston chamber 73 through the housing 66. A piston 75 is provided within the piston chamber 73, and a piston rod 76 is attached to the piston and extends into the bore 74. The piston is adapted for reciprocal movement in the piston chamber 73, and the piston rod is adapted for reciprocal movement within the bore 74.

The piston rod 76 has a rack 77 incorporated in the upper side thereof, and a gear 78 is adapted to mesh with the rack 77. The gear 78 is attached securely to the inner end of the spray tube 65, so that as the gear 78 rotates, the rotational movement is transmitted to the spray tube 65. Means are provided for diverting water from the cross bore 68 to the inner portion of the piston chamber 73, i.e., the portion of the piston chamber 73 between the piston 75 and the bore 74. Although not shown in the drawings, a flow passageway extends from the bore 71 to the inner portion of the piston chamber 73. The insert member 72 is adapted to occlude the flow passageway as the insert member 72 is advanced in the bore 71 and to open the passageway as the insert member 72 is retracted in the bore 71.

An opening (not shown) is provided through the body 66 to allow water to flow from the cross bore 68 to the inner portion of the piston chamber 73. Means are also provided for periodically releasing the pressure and exhausting water from the outer portion of the piston chamber 73, so that the piston 75 moves back and forth within the piston chamber 73 in the same manner as the movement of the piston 34 as described previously for the embodiment of the invention shown in FIGS. 1–7.

As illustrated, a flow passageway is provided from the closed end of the piston chamber 73 to a slide valve means which operates to open and close the passageway 80. An exhaust passage extends from the valve means and exhausts water to the atmosphere from the flow passageway 80 when the valve means is open. Preferably, the exhaust passageway 81 is designed to be incorporated with a nozzle-like extension 83 which is integral with and extends upwardly from the gear 78. As illustrated, a portion of the exhaust passageway 81 extends through the housing 66 to the end of the spray tube 65 which is imbedded in the bore 67 of the housing 66 and is attached to the gear 78. The hollow spray tube 65 is provided with a blockage means 84 spaced inwardly from the end thereof to which the gear 78 is attached, and the passageway 81, which incorporates the hollow end portion of the end of the spray tube 65 between the blockage means 84 and the gear 78, then continues through the upstanding nozzle portion 83 of the gear 78 to discharge to the atmosphere. As best shown in FIG. 12, the hollow end of the spray tube 65 near the intersection of the bore 67 and the passageway 81 is provided with a plurality of openings 85 through which water can pass from the passageway 81 to the hollow portion of the end of the spray tube 65. The blockage means 84 is advantageously provided by a solid section in the spray tube 65. The solid section is preferably provided with an O-ring seal 90 to seal the end portion of the spray tube 65 and the gear 78 from the portion of the spray tube on the other side of the blockage 84. The hollow end portion of the spray tube 65 is in flow communication with the continuation of the flow passage 81 which extends through the nozzle-like extension 83 on the gear 78 as shown in FIG. 12.

The slide valve 82 is operated by a lever means 86 which is mounted with a ribbon spring 87 in the same manner as described previously with respect to the lever 50 in the embodiment shown in FIGS. 1–7. The lever 86 thus operates with an over center, snap action movement similar to movement as previously described with respect to lever 50 of the embodiment shown in FIGS. 1–7. The lever 86 is moved back and forth over center of the spring by an actuator 88 which is mounted to the housing 66 for pivotal movement about an axis through one end of the activator 88. A pair of rotational pointers 89 are adjustably mounted to the pivotal end of the actuator 88 to impart rotational movement to the actuator 88. The rotational pointers 89 are in turn drawn in a pivotal movement by a contact member 91 extending backwardly from the free end portion of the nozzle-like extension 83 of gear 78.

In operation, as the piston 75 and rack 77 moves, the gear 78 and contact member 91 rotate about an axis through the imbedded end of the spray tube 65. As the gear 78 approaches the desired limit of its clockwise or counterclockwise movement, the contact member 91 engages one of the pointers 89. The pointer 89 then imparts rotation to the actuator 88 which in turn moves the lever 86 and slide valve 82. The movement of the slide valve 82 effects a reversal of the movement of the piston 75 and rack 77. This in turn, reverses the rotational movement of the gear 78 and spray tube 65. The gear 78 and spray tube 65 continue to rotate in the new direction until the contact member 91 engages the other pointer 89, whereupon the slide valve 82 is returned to its previous position thereby effecting a reversal in the movement of the piston 75, rack 77, gear 78 and spray tube 65. The adjustable pointers 89 thus define the limits of the oscillating movement of the gear 78 and spray tube 65.

Figure 16:
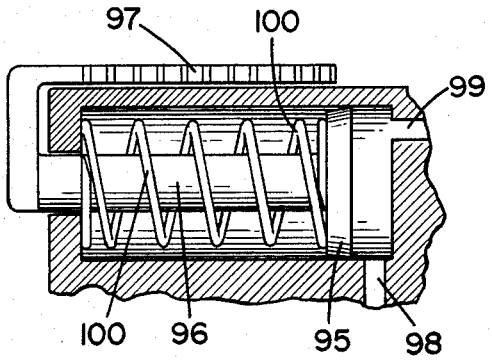
FIG. 16 is a cross-sectional schematic through the piston chamber of a further embodiment in which a mechanical spring is used to drive the piston in one of its directional movements.
Figure 4:
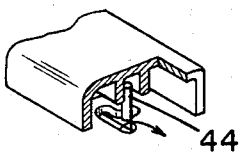
FIG. 4 is a partial pictorial of the external portion of the pressure release valve for the exit port of the piston chamber of the sprinkler nozzle of FIG. 1.

An alternative embodiment of a piston and piston chamber arrangement is shown diagramatically in FIG. 16. In the arrangement shown in FIG. 16, the piston is driven one way by fluid pressure and returns in the opposite direction under the force of a spring. In such an arrangement, the piston 95 has a piston rod 96 extending from the piston 95 and through one end of the piston chamber. The piston rod would be connected to a rack 97 in a manner as previously described from the embodiment of the sprinkler apparatus illustrated in FIGS. 1–13. Water under pressure would be supplied to the closed end of the chamber by an appropriate passageway 98. The water supply for the passageway 98 would come from the water being introduced into the sprinkler device in a manner similar to that described previously for the embodiments shown in FIGS. 1–13. Water from the chamber would be exhausted through a passageway 99 which would be associated with valve control means such as those fully described previously with respect to the apparatus shown in FIGS. 1–13.

A coil spring 100 is positioned coaxially around the piston rod 96 between the piston 95 and the end of the piston chamber through whch the piston rod 96 extends. When the valve associated with passageway 99 is closed, water pressure builds up in the piston chamber and forces the piston 95 to move against the force of the coil spring 100, thereby compressing the spring 100. When the valve associated with passageway 99 is open, water is exhausted from the piston chamber, and the coil spring 100 forces the piston 95 to move in the reverse direction so as to relieve the compression in the spring 100. Control means, such as previously described with respect to the apparatus of FIGS. 1–13, would be provided in combination with the valve means for passageway 99, and the rack 97 would be used to provide movement to a sprinkler in the same manner as previously described with respect to the apparatus of FIGS. 1–13.

Figure 14:
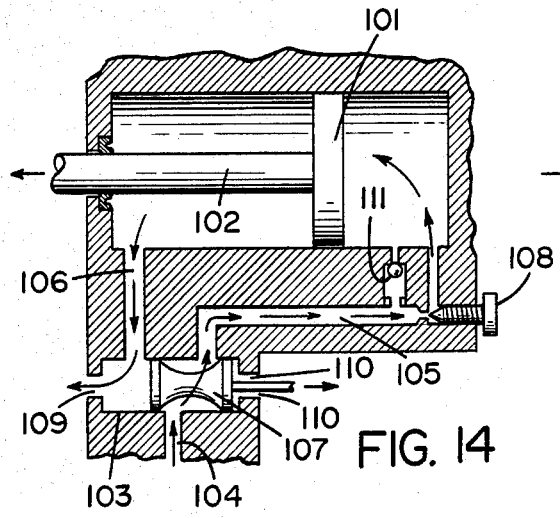
FIG. 14 is a cross-sectional schematic of an alternate embodiment of a piston chamber and pressure relief valve in which fluid in the chamber is admitted to and exhausted from both respective ends of the chamber.
Figure 15:
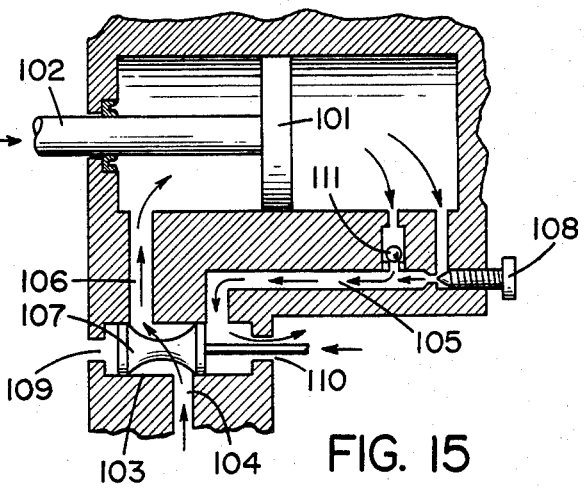
FIG. 15 is a cross-sectional schematic similar to FIG. 14 but showing the piston traveling in the reverse direction.

An even further alternative embodiment of a piston and piston chamber arrangement is shown diagramatically in FIGS. 14 and 15. In the arrangement shown in FIGS. 14 and 15, fluid pressure again drives the piston 101 in mutually opposite directions in the piston chamber. The piston 101 has a piston rod 102 extending from the piston 101 and through one end of the piston chamber. The piston rod 102 would be used to drive a rack (not shown) as previously disclosed herein. Water inlets and outlets would be provided at each end of the piston chamber, and means are provided for alternatively supplying water under pressure to one side of the piston 101 while exhausting water from the piston chamber on the other side of the piston 101. As illustrated, pressurized water would be supplied to a valve spool chamber 103 through a passageway 104. A passageway 105 would lead from one end of the valve spool chamber 103 to one end of the piston chamber. Another passageway 106 would lead from the other end of the valve spool chamber 103 to the other end of the piston chamber. A valve spool 107 is slidingly received in the valve spool chamber 103, and means would be provided for moving the valve spool 107 back and forth within the valve spool chamber 103.

When the valve spool 107 is moved to its one extreme position as shown in FIG. 14, water would flow from the passageway 104, around the valve spool 107, and through the passageway 105 to the one end of the piston chamber. A needle valve means 108 could be provided to regulate the rate of flow of liquid to the piston chamber. Water pressure on the front of the piston 101 facing the one end of the piston chamber would force the piston to move toward the other end of the piston chamber as shown in FIG. 14. Water on the back side of the piston 101 would be exhausted through passageway 106 to the valve spool chamber 103 and then out an orifice 109 in the end of the valve spool chamber 103. When the valve spool 107 is moved to its other extreme position as shown in FIG. 15, flow of water would be reversed. Water would flow from the passageway 104, around the valve spool 107, and through the passageway 106 to the other end of the piston chamber. The piston would move towards the one end of the piston chamber as shown in FIG. 15. Water on the front side of the piston 101 would be exhausted through passageway 105 to the valve spool chamber 103 and then out an orifice 110 in the other end of the valve spool chamber 103. A one-way ball valve 111 can be associated with the passageway 105 so as to shut the needle valve 108. This allows water to be exhausted from the front end of the piston through the ball valve 111, but when water is flowing to the piston chamber through passageway 105, the ball valve 111 is closed making the water go through the metering valve 108.

Figure 17:
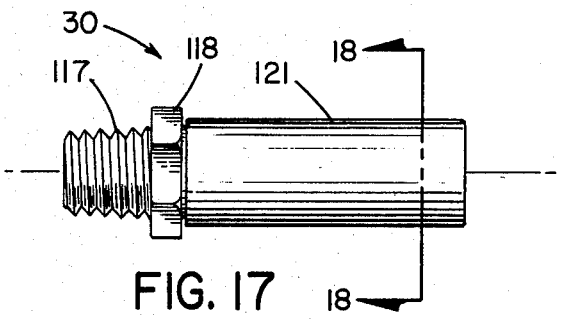
FIG. 17 is an elevational view of a preferred form of a water spray nozzle for the sprinkler of FIG. 1.
Figure 18:
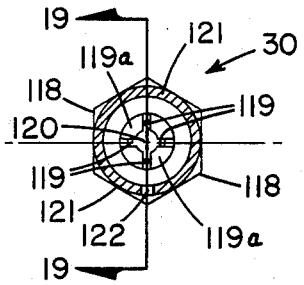
FIG. 18 is a cross-sectional view taken along line 18—18 of FIG. 17.
Figure 19:
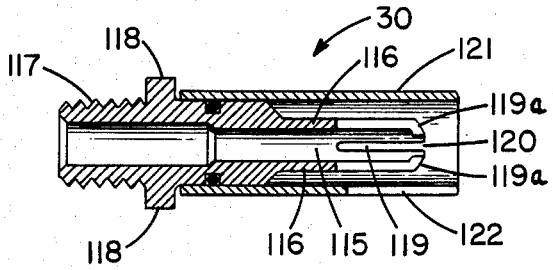
FIG. 19 is a cross-sectional view taken along line 19—19 of FIG. 18.

The embodiment of the sprinkler apparatus of FIGS. 1–10 further incorporates therein a unique, novel spray nozzle 30 which sprays a substantially uniform pattern throughout the length of the column of water which is being sprayed therefrom. The novel spray nozzle 30 achieves a remarkably uniform application of water over the entire area being irrigated from the area closest to the sprayer to the area most remote from the sprayer. The novel spray nozzle 30 is shown in more detail in FIGS. 17–19. It comprises a cylindrical, elongate flow channel 115 formed by an elongate cylindrical tube member 116.

As illustrated in FIGS. 17–20, the tube member 116 advantageously has one end provided with external threads 117 for connecting the nozzle 30 to a water supply such as the hollow tube member 31 of the sprinkler apparatus of FIGS. 1–10. At the inner end of the threads 117, an enlarged, hexagonal-shaped shoulder 118 is provided to be engaged by a wrench in threading the threads 117 into engagement with a receptacle such as the hollow tube member 31. The critical consideration in the spray nozzle 30 is the provision of four inwardly projecting slots 119 which extend inwardly from the free end of the cylindrical nozzle tube 116. The slots are equally spaced about the cylindrical tube 116 and extend in a direction substantially parallel to the longitudinal axis of the cylindrical tube 116.

The free end of the cylindrical tube 116 further has an inwardly extending annular lip **119*a* forming an annular orifice 120 through which the water is discharged from the nozzle 30. The slots 119 extend through the annular lip 119*a*, so that the portions of the tube 116 between the slots 119 form resilient fingers, with the water pressure acting against the portions of the annular lip 119***a* on each of the fingers. The orifice 120 has an effective diameter substantially smaller than the internal diameter of the cylindrical tube 116. Preferably, the diameter of the orifice 120 is about $\frac{1}{2}$ to about $\frac{2}{3}$ the internal diameter of the cylindrical tube 116.

A cylindrical shield 121 in preferably provided about the downstream portion of the cylindrical tube 116 such that the end of the shield 121 extends slightly beyond the free end of the cylindrical tube 116. Preferably, the shield 121 extends about $\frac{1}{8}$ to about $\frac{1}{2}$ inch beyond the free end of the cylindrical tube 116. The shield 121 is substantially coaxial with the cylindrical tube 116. Preferably, the inner diameter of at least the portion of the shield 121 extending beyond the free end of the cylindrical tube 116 is substantially greater than the inner diameter of the cylindrical tube 116. Preferably, the inner diameter of the portion of the shield 21 which extends from the cylindrical tube 116 is about 1.75 to 2.5 times greater than the inner diameter of the cylindrical tube 116.

As illustrated, the portion of the cylindrical tube 116 adjacent to the hexagonal shoulder 118 has a greater external diameter than does the downward end of the cylindrical tube 116, and the shield is adapted to fit tightly over the enelarged portion of the tube 116 as shown. The shield 121 preferably has a slot 122 extending inwardly from the free end thereof along the bottom side of the shield 121 substantially parallel to the longitudinal axis of the nozzle 30. The cylindrical tube 116 is preferably oriented such that one of the slots 119 therein faces downwardly and is in alignment in a vertical plane which the slot 122 in the shield 121.

It is to be understood that the present disclosure, including the detailed description of several preferred embodiments of the invention, is made by way of example and that various other embodiments are possible without departing from the subject matter coming within the scope of the following claims, which subject matter is regarded as the invention.

I claim:

1. A fluid drive, water sprinkler device including means for imparting reciprocating or oscillating motion to a sprinkler nozzle by fluid flow through the device, said sprinkler device comprising:

a body having a water inlet connection and a main water flow passageway therein;

a spray nozzle associated with the body and in fluid flow communication with the main water flow passageway;

a piston chamber formed within the body separate and apart from the main water flow passageway;

means for diverting a portion of the water from the main water flow passageway to the piston chamber;

a piston positioned for reciprocating movement within the piston chamber;

a rack connected to the piston and extending outside of the piston chamber, said rack being adapted to move outside the piston chamber with the same reciprocating motion as the piston;

a gear associated with body and spray nozzle and adapted to mesh with the rack so as to impart reciprocating or oscillating movement to the spray nozzle as the rack moves in its reciprocating motion; and means for varying the pressure of the water within the piston chamber to thereby control movement of the piston and rack.

2. A fluid drive, water sprinkler device in accordance with claim 1, wherein the means for varying the pressure of the water within the piston chamber comprises:

an exit port in fluid flow communication with one end of the piston chamber;

valve means associated with the exit port for controlling water discharge from the piston chamber through the exit port;

means for periodically opening and closing the valve means associated with the exit port; and means associated with said piston such that the piston is adapted to move away from said one end of the piston chamber when the valve at the exit port is closed, and to move toward said one end of the piston chamber when the valve at the exit port is open.

3. A fluid drive, water sprinkler device in accordance with claim 2, wherein said means for diverting water to the piston chamber comprises a diversion passageway between the main flow passageway and the piston chamber, with the diversion passageway opening into the piston chamber adjacent to or near the other end of the piston chamber, and said means associated with said piston comprises:

a shaft extending from the upstream end face of the piston which faces said other end of the piston chamber, said shaft in turn being connected to the rack; and a metering orifice through the piston so that water can flow through the metering orifice from the portion of the piston chamber on the upstream end face side of the piston to the portion of the piston chamber on the opposite or downstream end face side of the piston, whereby when said valve means is closed, water flows into the piston chamber and through the metering orifice so that water pressure is developed on both of the opposite end face sides of the piston, but because the effective area of the downstream end face of the piston is greater than that of the upstream end face of the piston, the piston moves away from said one end of the piston chamber, and when the valve means is open, water flows into the piston chamber, through the metering orifice and is exhausted through the exit port so that the differential pressure exerted on the upstream end face of the piston moves the piston toward said one end of the piston chamber.

4. A fluid drive, water sprinkler device in accordance with claim 2, wherein said means for diverting water to the piston chamber comprises a diversion passageway between the main flow passageway and the piston chamber, with the diversion passageway passageway opening into the piston chamber adjacent to or at said one end of the piston chamber, and said means associated with said piston comprises a resilient spring member positioned between the piston and the other end of the piston chamber, whereby when said valve means is closed water flows into the piston chamber and the pressure of the water in the piston chamber moves the piston against the bias of the spring member in a direction away from said one end of the piston chamber, and when the valve means is open, water flows from the piston chamber through the exit port and the spring bias moves the piston toward said one end of the piston chamber.

5. A fluid drive, water sprinkler device in accordance with claim 1, wherein the means for diverting a portion of the water from the main water flows passageway to the piston chamber includes a pair of diversion channels between the main flow passageway and the piston chamber, with the mutually respective diversion channels opening into the piston chamber adjacent to or near the opposite ends, respectively, of the piston chamber, and the means for varying the pressure of the water within the piston chamber comprises a two-way valve means associated with the pair of diversion channels such that when water flows to the piston chamber in one of the diversion channels, water is exhausted to the atmosphere through the other diversion channel and vice versa, and means are provided for alternating or periodically changing the positions of the two-way valve means whereby the direction of travel of the piston in the piston chamber reverses each time the two-way valve is changed.

* * * * *